US005713218A

United States Patent [19]

McCabe

[11] Patent Number: 5,713,218

[45] Date of Patent: Feb. 3, 1998

[54] DECORATIVE ARTICLE OF MANUFACTURE

[75] Inventor: Geoffrey McCabe, Seattle, Wash.

[73] Assignee: 7th Sense, Inc., Merrick, N.Y.

[21] Appl. No.: 663,456

[22] Filed: Jun. 13, 1996

[51] Int. Cl.[6] ..... A44C 5/00

[52] U.S. Cl. ..... 63/3.1; 63/37; 63/42; 63/15.05; 132/246; 132/275

[58] Field of Search ..... 63/1.1, 3, 4, 11, 63/15, 15.45, 15.6, 37, 42; 132/246, 247, 273, 275

[56] References Cited

U.S. PATENT DOCUMENTS 2,066,709 1/1937 Adams ..... 132/246

2,450,136 9/1948 Hamilton ..... 63/3

2,693,809 11/1954 Spencer ..... 132/246

5,499,638 3/1996 Ripley ..... 132/246 X

FOREIGN PATENT DOCUMENTS 1061105 12/1956 Germany ..... 63/3

*Primary Examiner*—Kien T. Nguyen

*Attorney, Agent, or Firm*—Pennie & Edmonds LLP

[57] ABSTRACT

An article of manufacture is formed of an elongated wire which is being bendable between a straight shape and an arcuate shape, a length of cord-like material braided circumferentially about the wire. The article of manufacture may be made of different lengths so as to serve different purposed such as a bracelet, a ring, or a hair band.

22 Claims, 3 Drawing Sheets

DECORATIVE ARTICLE OF MANUFACTURE

This invention relates to a decorative article of manufacture. More particularly, this invention relates to an article of manufacture capable of multiple uses, such as a bracelet, a ring and a hair tie.

As is known, various types of articles of manufacture have been used for novelty items, decorative purposes and the like. For example, it has been known to braid or knot pieces of cord-like materials, for example, made of cotton, into various elongated structures. In particular, using a macrame technique, it has been known to knot threads or cords into various lengths and geometric patterns.

In the past, macrame bracelets have been known in which a length of cord is knotted into an elongated strip which can be provided with a fastening means at each end so that the strip may be secured about the wrist of a person in the form of a bracelet.

It is an object of this invention to provide an article of manufacture of cord-like material which can be used not only as a bracelet but for other purposes.

It is another object of the invention to provide a pliable article of manufacture which can be used as a hair tie.

It is another object of the invention to provide an article of manufacture which does not require fastening elements at the ends in order to form a self-holding loop or loops.

Briefly, the invention provides an article of manufacture which is comprised of an elongated wire which is characterized in being bendable from a straight shape into at least an arcuate shape and back as well as a length of cord-like material braided about the wire from one end to an opposite end.

In one embodiment, the article of manufacture is in the form of a strip of limited length, for example, of a length which makes the article of manufacture useful as a bracelet. In this respect, the article of manufacture may be readily bent about the wrist of a person to form an open loop bracket or a closed loop bracelet. In the latter case, one end of the article is provided with a loop which is formed by the cord-like material. This loop is sized to receive the opposite end of the article in an interfitting relation in order to secure the article about a person's wrist where desired.

The article may also be used as a hair-tie, for example, to tie up hair in a pony-tail. In this case, the article is wrapped about the pony-tail, for example two or three times. Due to the pliable nature of the article and particularly the bendable wire, the article takes on a spiral shape which is self-holding. That is, the article will retain the bent shape about the hair until the user decides to loosen the hair-tie.

The wire which is used in making the article is made of steel and particularly a 19 gauge black steel. In this respect, the material of the wire should be such that it is self-supporting while being pliable and bendable, that is to say, the wire is characterized as being bendable from a straight shape into an arcuate shape or a looped shape and back again to a straight shape without damaging the characteristics of the wire. Thus, the article of manufacture can be used interchangeability as a bracelet and a hair-tie multiple times.

The article of manufacture may, of course, be made of different lengths so as to serve different purposes. For example, the article of manufacture may be made of a length which is suitable to function as a hair band so as to be placed transversely across the head of a person. Further, the article of manufacture may be made of a relatively short length so as to function as a ring which can be placed about a person's finger.

The cord-like material which is braided about the wire is preferably selected from the group consisting of waxed cotton, hemp, leather and suede. In particular, one material which has been found to be particular suitable is a 16 W 2 millimeter waxed cotton.

When constructing the article of manufacture, a single length of cord-like material is preferably used. In this case, the two free ends of the cord-like material may be secured together, for example, by means of a glue or other suitable means.

In another embodiment, the article of manufacture may incorporate one or more decorative bodies. For example, in one embodiment, a decorative body of disc shape is placed at an intermediate point of the length of the article. In this case, the decorative body has a bore which passes diametrically through the body so as to accommodate passage of the bendable wire. Further, in this embodiment, the cord-like material is braided circumferentially about the body.

In still another embodiment, multiple decorative bodies may be incorporated into the article. In each case, each decorative body has a bore to accommodate passage of the wire while the cord-like material is braided about each body in a circumferential manner.

In still another embodiment, a decorative body of disc-shape may be rotatably mounted on the bendable wire within the circumferentially disposed section of the cord-like material so as to be rotated to present one or the other face of the disc to view from time-to-time.

These and other objects and advantages of the invention will become more apparent from the following detailed disclosure taken in conjunction with the accompany drawings wherein.

Figure 1:
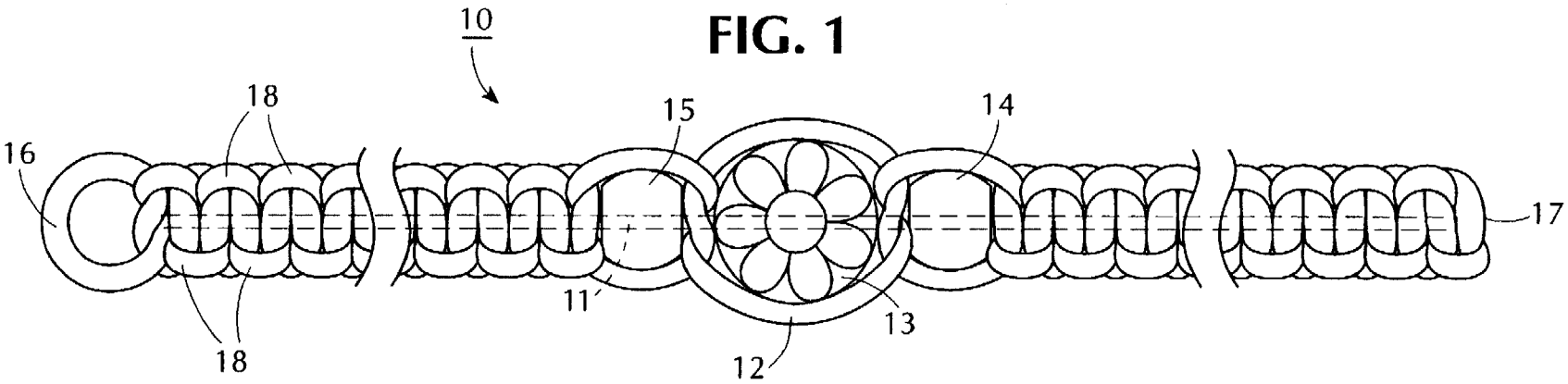
FIG. 1 illustrates a view of an article of manufacture constructed in accordance with the invention.

Referring to FIG. 1, the article of manufacture is constructed to form a bracelet 10. As indicated, the bracelet 10 is formed of an elongated wire 11, a length of cord-like material 12 and a decorative body 13 disposed centrally of the bracelet 10. The bracelet 10 also has one or more decorative bodies 14, 15 disposed on opposite sides of the centrally located decorative body 13.

Figure 9:
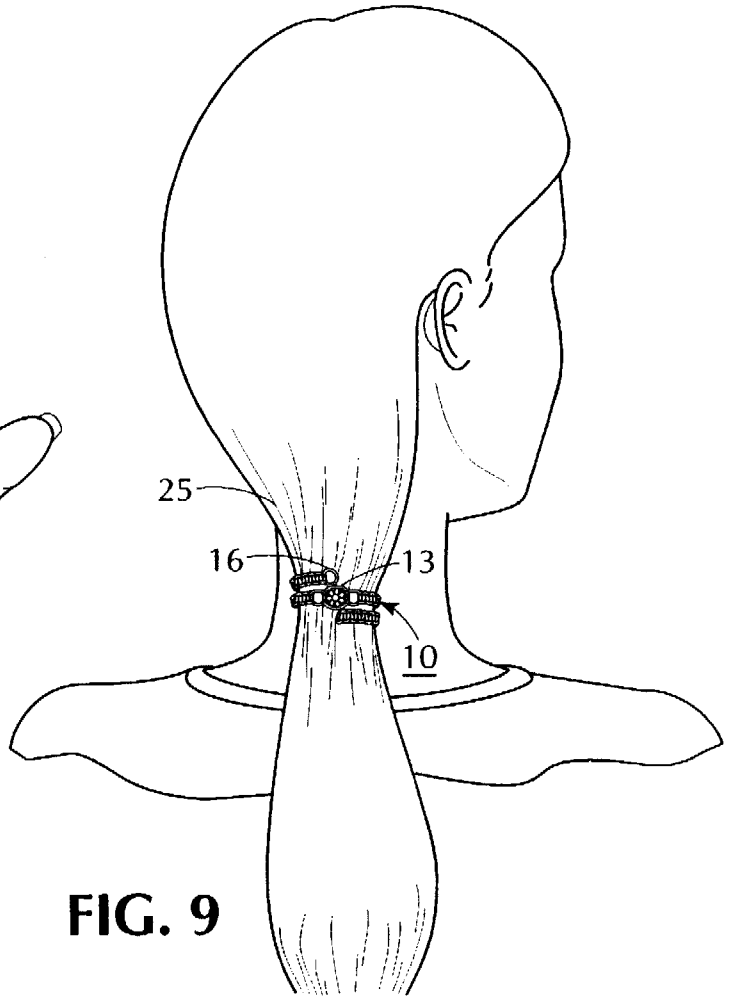
FIG. 9 illustrates the article of manufacture used as a hair-tie in accordance with the invention.
Figure 8:
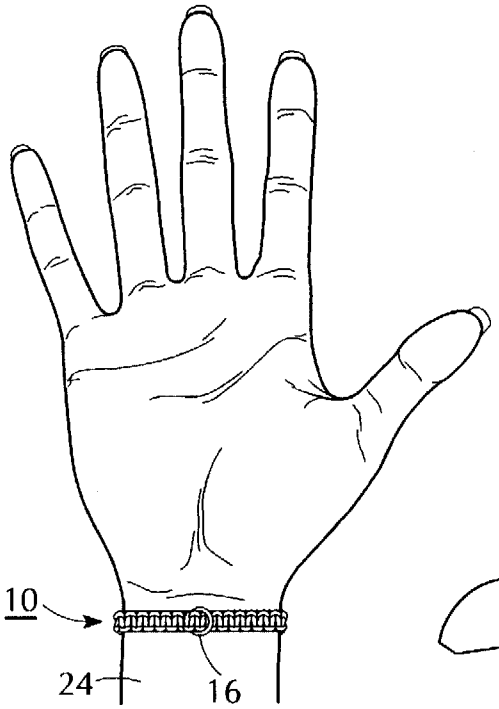
FIG. 8 illustrates a view similar to FIG. 7 of the attached ends of the article of FIG. 7.
Figure 7:
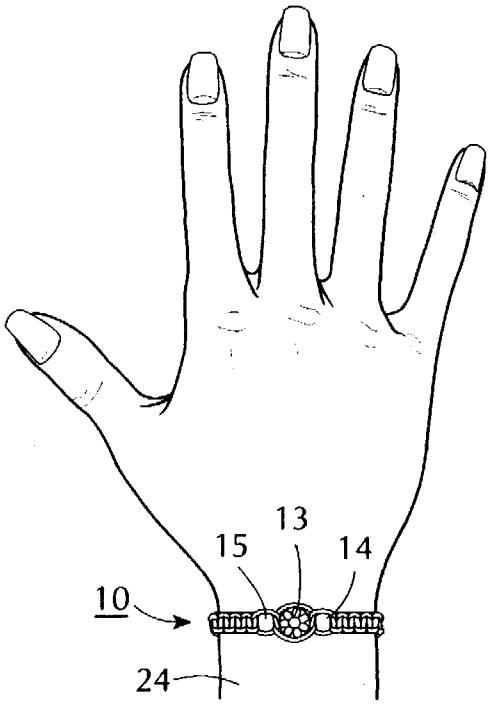
FIG. 7 illustrates a view of the article of manufacture on a wrist of a person in the form of a bracelet.

The wire 11 is characterized in being bendable from a straight shape into at least an arcuate shape (see FIGS. 7 and 8) and in being bendable back into a straight shape multiple times. The wire is made of a 19 gauge black steel but may also be made of any other suitable material which is capable of performing the functions of the wire. That is to say, the wire 11 must be able to bend into an arcuate shape, such as shown in FIGS. 7 and 8 or into a spiral shape as indicated in FIG. 9 with one or more loops, while being capable of being bent back into a straight shape without damage to the wire. The pliability of the wire is such that the wire may be flexed and bent multiple times without fatigue in the material occurring.

The cord-like material 12 is selected from the group consisting of waxed cotton, hemp, leather and suede. For example, the cord-like material 12 is made of 16 W 2 millimeter waxed cotton.

The nature of the cord-like material 12 is similar to that of the wire 11 in the sense that the cord-like material 12 is pliable and can be bent into arcuate shapes from a straight shape without unraveling.

As indicated in FIG. 1, the cord-like material 12 is formed into a series of knots using a macrame technique.

The cord-like material 11 forms an integral loop 16 at one end while the free ends are secured together by suitable glue means 17 at the opposite end.

Figure 2:
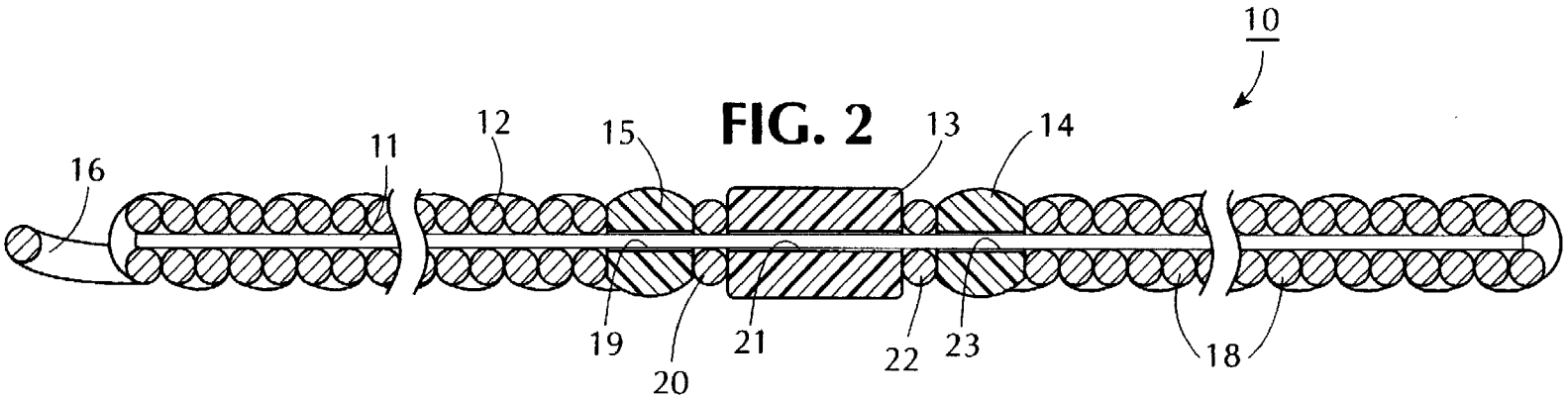
FIG. 2 illustrates a cross sectional view of the article of manufacture of FIG. 1.
Figure 6:
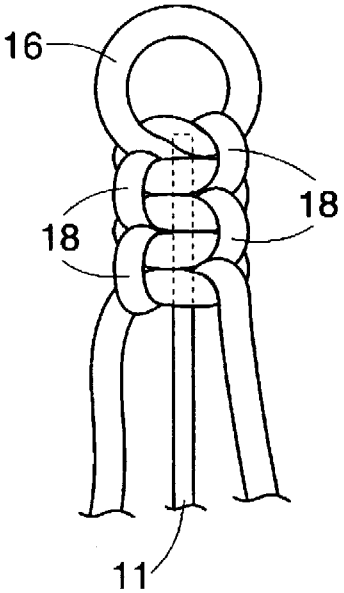
FIG. 6 illustrates a completed end of the article of manufacture with an integral loop in accordance with the invention.
Figure 5:
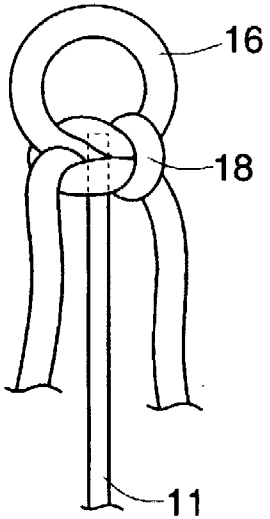
FIG. 5 illustrates the article of manufacture during manufacture to form a knot to encase one end of the bendable wire of the article in accordance with the invention.
Figure 4:
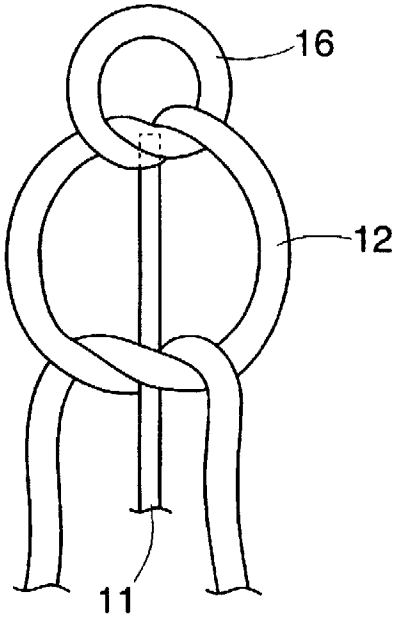
FIG. 4 illustrates the article of manufacture in a second step following the step of FIG. 3.
Figure 3:
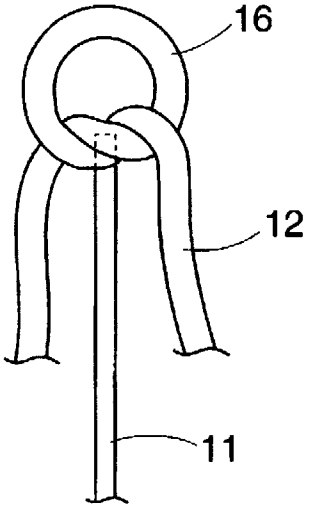
FIG. 3 illustrates the article of manufacture during a step in the process of making the article in accordance with the invention.

In order to form the bracelet 10, the cord-like material 12 is first formed into a loop 16 at one end as indicated in FIG. 3. At this time, the loop 16 is placed about the end of the wire 11. Next, a knot 18 is formed by the cord-like material 12 as indicated in FIGS. 4 and 5. Upon closing of the knot 18 into the tightened form shown in FIG. 5, the end of the wire 11 becomes embedded within the knot 18. Subsequent knots 18 are then formed by the cord-like material 12 about the wire 11 in a manner as indicated in FIG. 6. Continued knotting of the material 12 about the wire 11 continues until reaching the position for the first decorative body 15. At this time, the decorative body 15 is threaded onto the wire 11 via a bore 19 (see FIG. 2) in the body 15. This body 15 may be in the form of a round bead so as to be freely rotatable on the wire 11. Next, the cord-like material 12 is disposed circumferentially about the body 15 and another knot 20 is formed to hold the body 15 in place.

Thereafter, the centrally located disc 13 is slid onto the wire 11 via a bore 21 extending through the disc 13. Again, the cord-like material is disposed circumferentially about the disc 13 and a single knot 22 is formed to hold the disc 13 in place. In this respect, it is noted that the disc 13 is also rotatably mounted on the wire 11 and may be fixed relative to the cord-like material 12 so as to be prevented from rotating on the wire. Alternatively, the disc 13 may be mounted in a looser condition between the knots 20, 22 so as to be rotated to permit either the front side or back side of the disc to be exposed for decorative purposes.

Thereafter, the third body 14 is slid onto the wire 11 via a bore 23 (see FIG. 2) which passes through the body 14. The cord-like material 12 is then knotted along the remaining length of the wire 11 to form additional knots 18 to hold the body 14 in place. In this respect, the wire may be cut to an appropriate length at this time, if required. Upon reaching the free end of the wire 11, a further knot or knots are made and the two free ends (not shown) of the cord-like material 12 are secured together, for example by means of a glue to prevent unraveling.

The bracelet 10 may then be placed about the wrist 24 of a user, for example, as shown in FIG. 7. Because of the bendable pliable nature of the wire 11 and to a lesser extent, the cord-like material 12, the bracelet 10 need not completely encircle the user's wrist 23. That is to say, the bracelet 10 may be used in an open-loop manner. Alternatively, as indicated in FIG. 8, the bracelet 10 may be used in a closed loop manner. To this end, the free end of the bracelet 10 is slid through the loop 16 at the opposite end. Because of the undulating shape of the longitudinal edges of the bracelet 10 caused by the macrame process, the free end of the bracelet 10 will not readily slip from within the loop 16.

Because the ends of the wire 11 are embedded within the knots 18 formed by the cord-like material 12, the tips of the wire do not show. Thus, the wire 11 is hidden from view and does not detract from the overall aesthetic appearance of the macrame structure.

Referring to FIG. 9, the bracelet 10 may alternatively be used as a hair-tie. To this end, the bracelet 10 may be wrapped two or more times around the hair 25 of a person to form a pony-tail.

In still another embodiment (not shown), the article may be made of a shorter length than as shown in FIG. 1 with the loop 16 of FIG. 1 eliminated. Such a shortened length of the article may be used to form an open-loop ring. In addition, in this embodiment, use may be made of only the centrally disposed disc 13 to form a solitaire-type ring. Of course, additional bodies may be provided locally through the wire to provide other aesthetic appearances to the ring.

The decorative bodies which are incorporated into the article of manufacture 10 may have various types of designs. For example, the bodies may be made of a clay such as a Fimo clay with an integral design therein. For example, as indicated in FIG. 1, the disc-like body 13 has a multi-colored design 26 which is of mirror image design on front and back. In this respect, if the design is a purely symmetrical design, rotation of the disc 13 to show the front face or back face would give the same visual impression. However, where the design 25 is asymmetrical, that is to say, if the design 25 included a depiction of the petals of a flower being directed in a right-hand direction, the obverse face would show the petals in a left-hand direction i.e. a mirror-image. Such is the nature of a body being made of Fimo clay with an integral design therein.

Obviously, the disc 13 can be made of any suitable material such as a metal silver, and the like. Likewise, the designs on one face may be quite distinct from the designs on the obverse face.

The invention thus provides an article of manufacture which has multiple uses, including but not limited to use as a bracelet, ring or hair tie. Further, the invention provides an article of manufacture which can be made in different lengths to suit different purposes.

Further, the invention provides an article of manufacture which can be bent into different shapes multiple times in order to provide for different uses of the article.

What is claimed is:

1. An article of manufacture comprising an elongated wire characterized in being bendable between a straight shape and at least an arcuate shape; and a length of cord-like material braided about said wire from one end of said wire to an opposite end of said wire, said material conforming to each said shape of said wire.

2. An article of manufacture as set forth in claim 1 wherein said wire is made of steel.

3. An article of manufacture as set forth in claim 2 wherein said steel wire is 19 gauge black steel.

4. An article of manufacture as set forth in claim 1 wherein said cord-like material is selected from the group consisting of waxed cotton, hemp, leather and suede.

5. An article of manufacture as set forth in claim 4 wherein said cord-like material is a 16 W 2 millimeter waxed cotton.

6. An article of manufacture as set forth in claim 1 wherein said length of cord-like material has a pair of ends at one end of said wire, and which further comprises glue means for securing said pair of ends together.

7. An article of manufacture as set forth in claim 1 wherein said length of cord-like material defines a loop at one end of said wire and at least a pair of knots adjacent said loop, said knots having said one end of said wire embedded therein.

8. An article of manufacture as set forth in claim 1 which further comprises a decorative body disposed intermediately of said wire, said body having a bore extending therethrough with said wire passing therethrough, said length of material being disposed circumferentially about said body.

9. An article of manufacture as set forth in claim 8 wherein said decorative body is made of clay with an integral design therein.

10. An article of manufacture as set forth in claim 9 wherein said design is non-symmetrical.

11. A bracelet comprising a decorative body having a bore passing therethrough;

an elongated bendable wire passing through said bore in said body; and a length of cord-like material braided about said wire in macrame manner from one end of said wire to an opposite end of said wire and being disposed circumferentially about said body.

12. A bracelet as set forth in claim 11 wherein said wire is made of steel.

13. A bracelet as set forth in claim 12 wherein said steel wire is 19 gauge black steel.

14. A bracelet as set forth in claim 11 wherein said cord-like material is selected from the group consisting of waxed cotton, hemp, leather and suede.

15. A bracelet as set forth in claim 11 wherein said length of cord-like material defines a loop at one end of said wire and at least one knot adjacent said loop, said knot having said one end of said wire embedded therein.

16. A bracelet as set forth in claim 11 wherein said body is selected from the group consisting of discs and beads.

17. A bracelet as set forth in claim 11 wherein said body is made of clay with an integral design therein.

18. A bracelet as set forth in claim 11 wherein said decorative body is a disc rotatably mounted on said wire and rotatable within said cord-like material circumferentially disposed about said body.

19. A bracelet as set forth in claim 18 wherein said disc has a first design on one face an a second different design on an opposite face.

20. A ring comprising a decorative body having a bore passing therethrough;

a bendable pliable wire passing through said body and defining a closed circular shape; and a length of cord-like material braided about said wire and being disposed circumferentially about said body.

21. A ring as set forth in claim 20 wherein said body is selected from the group consisting of discs and beads.

22. A ring as set forth in claim 20 wherein said body is made of clay with an integral non-symmetrical design therein.

* * * * *